US007998032B2

(12) United States Patent
Schroeder

(10) Patent No.: US 7,998,032 B2
(45) Date of Patent: Aug. 16, 2011

(54) BICYCLE TRAINER

(75) Inventor: Duane G. Schroeder, New Hope, MN (US)

(73) Assignee: Kurt Manufacturing, Inc., Minneapolis, MN (US)

( * ) Notice: Subject to any disclaimer, the term of this patent is extended or adjusted under 35 U.S.C. 154(b) by 0 days.

(21) Appl. No.: 12/273,280

(22) Filed: Nov. 18, 2008

(65) Prior Publication Data

US 2009/0075785 A1 Mar. 19, 2009

Related U.S. Application Data

(63) Continuation of application No. 11/535,854, filed on Sep. 27, 2006, now abandoned.

(60) Provisional application No. 60/720,842, filed on Sep. 27, 2005.

(51) Int. Cl.
*A63B 69/16* (2006.01)

(52) U.S. Cl. ..... 482/61

(58) Field of Classification Search ..... 482/51, 482/57, 61; *A63B 69/16*
See application file for complete search history.

(56) References Cited

U.S. PATENT DOCUMENTS

| | | | |
|---|---|---|---|
| 2,623,302 | A | 12/1952 | Shields |
| 3,758,107 | A | 9/1973 | Potgieter |
| 4,415,152 | A | 11/1983 | Smith |
| 4,572,502 | A | 2/1986 | Messineo |
| 4,580,983 | A | 4/1986 | Cassini et al. |
| 4,817,939 | A | 4/1989 | Augspurger et al. |
| 4,932,651 | A | 6/1990 | Defaux |
| 4,955,600 | A | 9/1990 | Hoffenberg et al. |
| 4,958,832 | A | 9/1990 | Kim |
| 5,035,418 | A | 7/1991 | Harabayashi |
| 5,050,865 | A | 9/1991 | Augspurger et al. |
| 5,152,729 | A | 10/1992 | Phillips |
| 5,240,417 | A | 8/1993 | Smithson et al. |
| 5,364,271 | A | 11/1994 | Aknin et al. |
| 6,004,243 | A | 12/1999 | Ewert |
| 6,126,577 | A | 10/2000 | Chang |
| 6,322,480 | B1 | 11/2001 | Lim et al. |
| 6,413,197 | B2 | 7/2002 | McKechnie et al. |
| 6,508,745 | B1 | 1/2003 | Schenk et al. |
| 6,702,721 | B2 | 3/2004 | Schroeder |
| 7,081,070 | B1 | 7/2006 | Washington et al. |
| 7,326,151 | B2 | 2/2008 | Peterson et al. |
| 2001/0031686 | A1 | 10/2001 | Ware |
| 2002/0055422 | A1 | 5/2002 | Airmet et al. |
| 2002/0077221 | A1 | 6/2002 | Dalebout et al. |
| 2003/0073546 | A1 | 4/2003 | Lassanske et al. |
| 2004/0053751 | A1 | 3/2004 | Pizolato |
| 2006/0234839 | A1 | 10/2006 | Peterson et al. |

OTHER PUBLICATIONS

The Merriam-Webster Dictionary, definition of "twist", 3 pages, http://www.merriam-webster.com/dictionary/twist.* The Merriam-Webster Dictionary, definition of "rod", 2 pages, http://www.merriam-webster.com/dictionary/rod.*
The Merriam-Webster Dictionary, definition of "bar", 2 pages, http://www.merriam-webster.com/dictionary/bar.*

* cited by examiner

*Primary Examiner* — Loan Thanh
*Assistant Examiner* — Oren Ginsberg
(74) *Attorney, Agent, or Firm* — Stevn M. Koehler; Westman, Champlin & Kelly, P.A.

(57) ABSTRACT

A bicycle trainer is adapted for use with a bicycle. The trainer includes a base and a frame having spaced apart ends adapted to engage and support the bicycle. A pivoting assembly is joined to the frame of a central portion of the frame and to the base. The pivoting assembly allows movement between the frame and the base and includes a biasing mechanism that resists tilting of the frame relative to the base. The frame is supported only by the pivoting assembly.

20 Claims, 6 Drawing Sheets

BICYCLE TRAINER

CROSS-REFERENCE TO RELATED APPLICATION

The present application is a continuation of and claims priority of U.S. patent application Ser. No. 11/535,854, filed Sep. 27, 2006, which claims the benefit of U.S. provisional application Ser. No. 60/720,842, filed Sep. 27, 2005, the contents of which both are hereby incorporated by reference in their entirety.

BACKGROUND

Bicycle trainers have been used by bicycle enthusiasts to convert their bicycles for stationary riding. A typical user is a bicycle owner who competes in various bicycle races or rides often. When the weather prevents riding outdoors, such as when it is raining, too cold or too hot, the cyclist can use the trainer indoors to simulate a ride. In some cases, the cyclist may want to use a trainer while also reading or watching television. However, in all cases, the bicycle trainer should be easy to use and simulate bicycle riding.

A common bicycle trainer has a frame onto which the user mounts the bicycle. Typically, the rear wheel of the bicycle is in contact with a roller that, in turn, is coupled to a resistance unit. The roller is supported by the frame at a fixed distance from couplers that engage and support the bicycle in an upright generally stationary position.

SUMMARY

A bicycle trainer is adapted for use with a bicycle. The trainer includes a base and a frame having spaced apart ends adapted to engage and support the bicycle. A pivoting assembly is joined to the frame at a central portion of the frame and to the base. The pivoting assembly allows movement between the frame and the base and includes a biasing mechanism that resists tilting of the frame relative to the base. The frame is supported only by the pivoting assembly.

DETAILED DESCRIPTION

Figure 1:
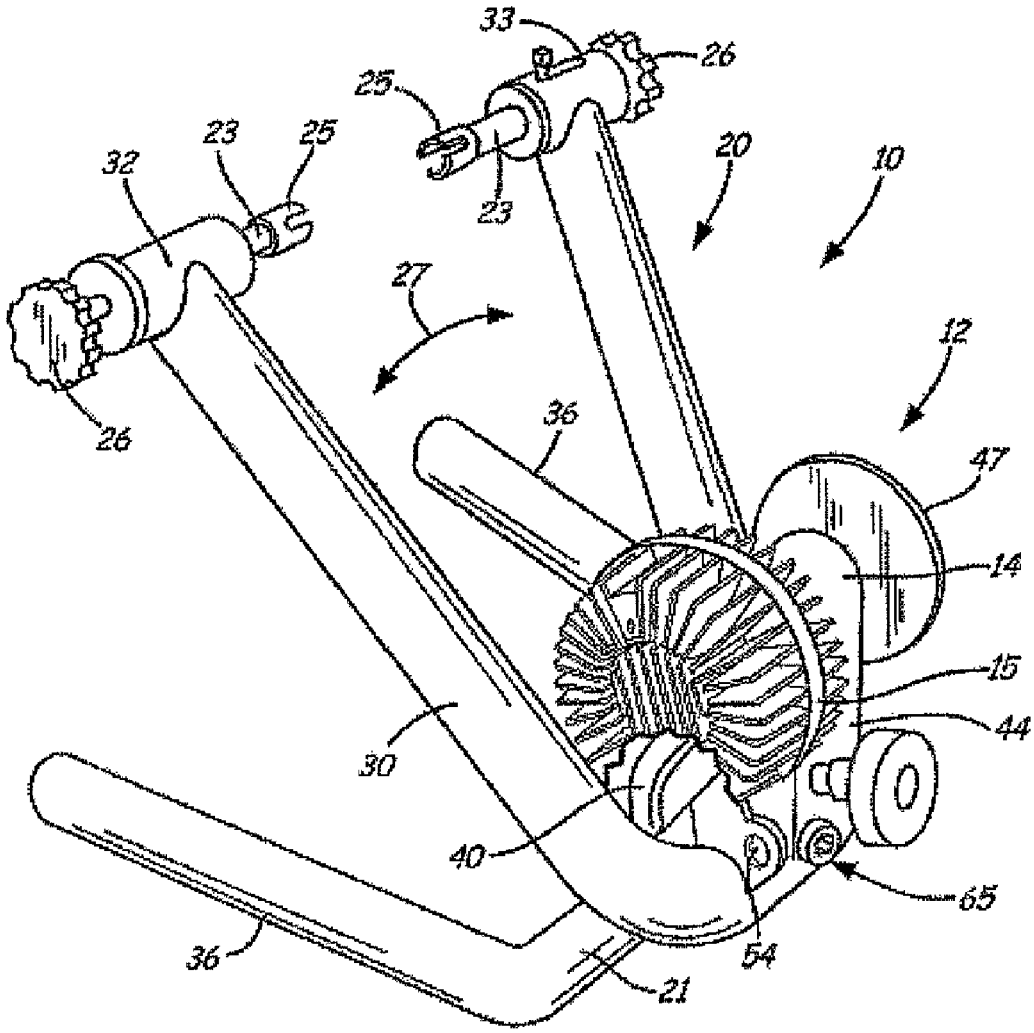
FIG. 1 is an isometric view of a bicycle trainer.

An exemplary embodiment of an exerciser 10 with a movable resistance device 12 is illustrated in FIG. 1. As well known to those skilled in the art, the exerciser 10 is a bicycle trainer that is adapted to support a tire and wheel of a bicycle or other pedaled device (hereinafter "bicycle" by way of example, and used as a representation of all types of pedaled devices). The resistance device 12 includes a roller 14 that engages a tire of the bicycle. The resistance device 12 typically includes a rotatable resistance assembly 15 such as an impeller rotatable in a fluid such as oil. However, it should be understood that the trainer can be used with many forms of resistance devices wherein the specific implementation provided herein should not be limiting. The exerciser 10 includes a frame 20 used to support the rotating wheel of the bicycle.

In the exemplary embodiment illustrated, the frame 20 includes opposed support ends 32 that support couplers 25, also referred to as axle engagement members, with handles 26 for releasably supporting the bicycle above a floor. The frame 20 includes a center portion 30 that is "U" or "V" shaped, generally referred to as a hyperboloid, wherein the support ends 32 are spaced apart. In this embodiment, the couplers 25 engage opposed portions of a wheel of the bicycle. Each of the couplers 25 include rods 23, that are slidable in apertures in support ends 32 in the frame 20 in order to adjust couplers 25 axially to engage the bicycles. The type of couplers illustrated herein are merely exemplary in that many forms can be used without departing from the invention.

Frame 20 supports the bicycle by engaging a portion thereof. In the embodiment illustrated, two spaced-apart legs having support ends 32 and 33 are used; however a single support leg can be used if desired.

A base 21 is coupled to frame 20 allowing limited movement thereof in a manner discussed below. In the embodiment illustrated, base 21 includes extending legs 36 that generally lay flat. The base 21 is U-shaped having remote ends that terminate away from the frame 20. However, base 21 can take many forms including, but not limited to, any type of structure that utilizes tubular supports and/or a planar shaped base portion that rests on a surface. In general, base 21 provides a stable support for frame 20 and a bicycle attached thereto.

A pivoting assembly or coupler 40 couples frame 20 to base 21 in order to allow tilting movement (illustrated by double arrow 27) of frame 20 with respect to base 21 so as to allow the bicycle attached thereto to tilt from side to side. It is quite common for a cyclist when riding a bicycle to cause the bicycle to tilt side to side when pedaling. This may be most pronounced when the cyclist is standing while pedaling and not sitting down. The bicycle will tilt from side to side on "contact patches" of the tires with the ground. Current bicycle trainers support the bicycle in a fixed or stationary upright position. In one embodiment, coupler 40 is resistive to tilting movement, and in yet a further embodiment, provides a restoring force that counteracts downward tilting movement and aids in restoring the bicycle to an upright position.

The resistance device 12 includes a mounting bracket 44. The mounting bracket 44 supports a shaft of the resistance device 12 to which roller 14 is secured. In the embodiment illustrated, an impeller unit 15 is mounted to a first end of the shaft, while a flywheel 47 is provided on an end opposite the impeller unit 15. In the embodiment illustrated, the mounting bracket 44 can be secured to the frame 20 to move therewith and thus also tilts with the bicycle wherein no significant tilting movement of the bicycle wheel/tire occurs between the wheel/tire and the roller 14. A frame mounting flange 54 is secured to the center portion 30. In order to provide some accommodation for wheels of different diameters, the mounting bracket 44 can pivot relative to the frame 20.

Figure 2:
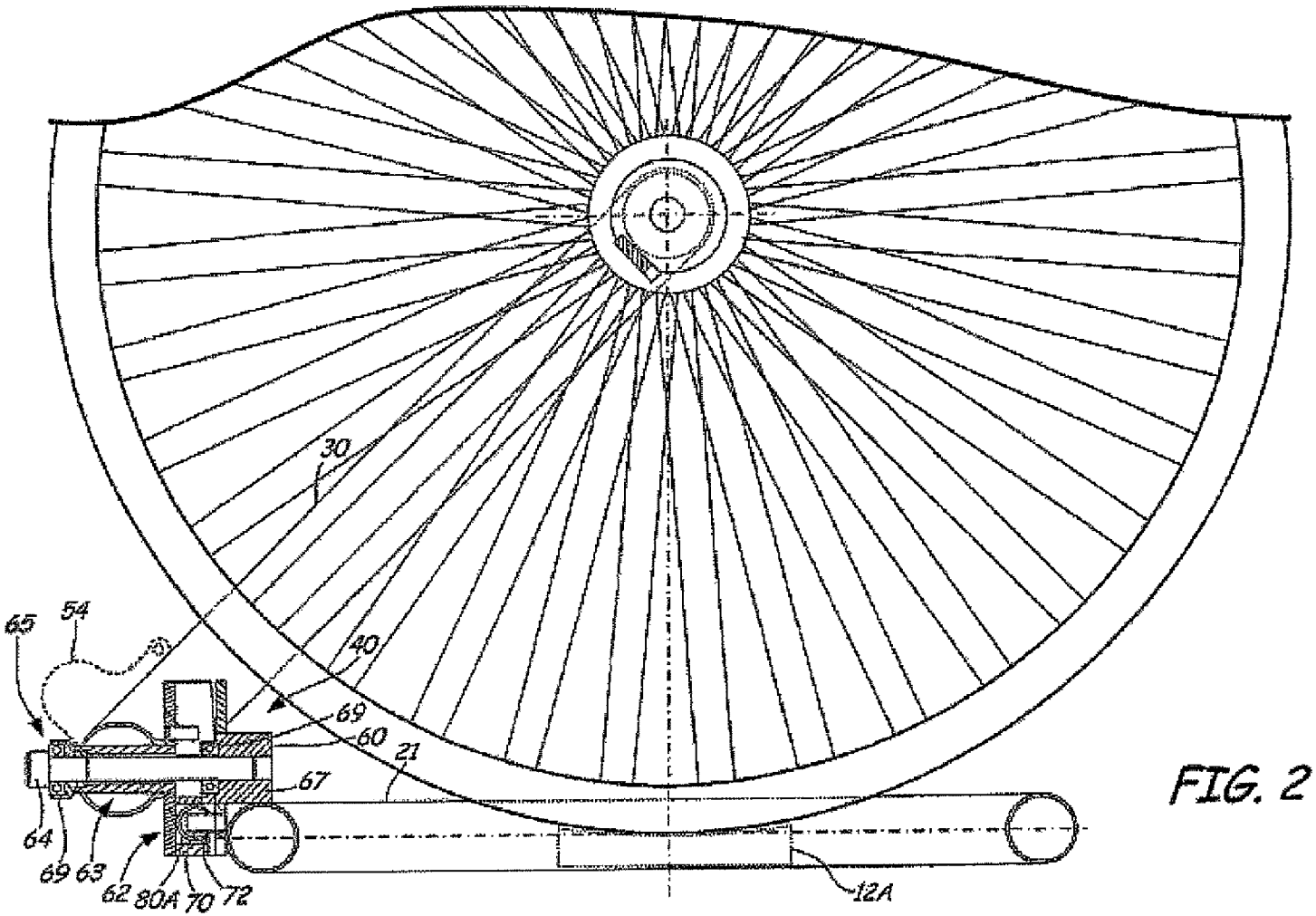
FIG. 2 is a side view of a bicycle trainer and a wheel of a bicycle.

It should be noted in a further embodiment, the resistance device 12 can be mounted to base 21, or otherwise provided in a stationary position such that the frame 20 still supports the bicycle allowing tilting movement, but the wheel/tire also tilts with respect to the engaging surface of the resistance device. In FIG. 2, resistance device 12A illustrated in dashed line schematically illustrates this embodiment.

In the embodiment illustrated in FIG. 2, coupler 40 includes a first support 60 attached to base 21 and a second support 62 attached to frame 20. A coupling element 63 allows the first support 60 to move relative to the second support 62. In the embodiment illustrated, the second support 62 partially rotates relative to first support 60 about an axis 64 extending through coupling element 63, herein a pivot stud 65

Figure 4:
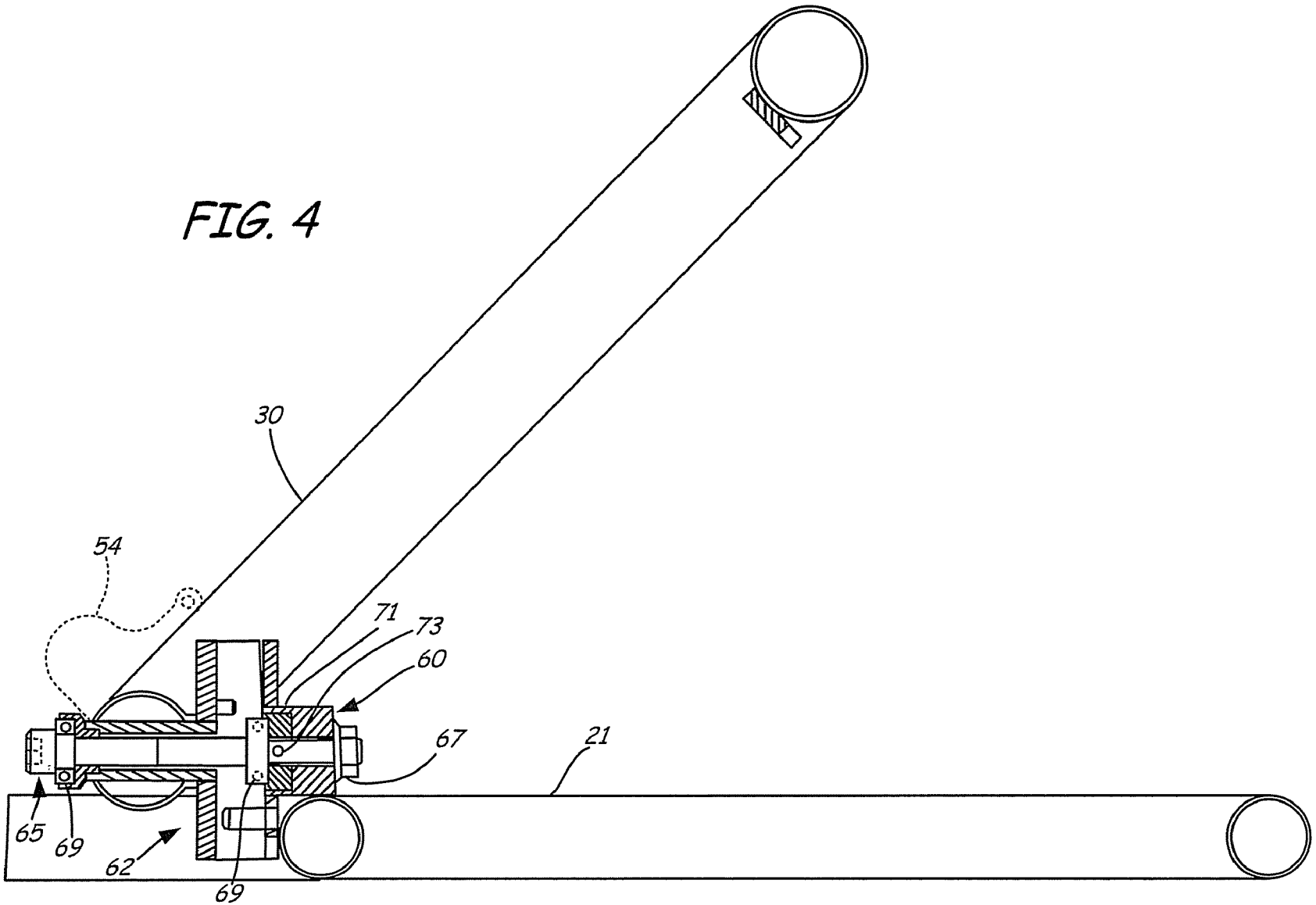
FIG. 4 is a side view of a bicycle trainer.

(e.g. threaded bolt) having a threaded mating nut 67 so as to provide tilting movement of frame 20 and thus the bicycle attached thereto. Bearing assemblies 69 allow partial rotation of support 62 on stud 65. In FIG. 4, a nut 67 mates with stud 65 and a washer 71 is provided and secured to stud 65 with set screw 73 so as to maintain a desired preload on bearing assemblies 69.

In one embodiment, the relative positions of the roller 14 on frame 20, and frame 20 on second support 62, or other components comprising the trainer, are disposed relative to each other such that axis 64 is disposed substantially below an axle of the bicycle and commonly proximate to the contact patches of the tires of the bicycle with the ground, if the bicycle was actually riding thereon. If desired, a front support assembly (not shown) can be used to support the front portion of the bicycle so that the contact patches of the front and rear tires would be level.

If desired, stops can be provided so as to limit tilting movement of frame 20 relative to base 21 from side to side. Such stops can take many forms as appreciated by those skilled in the art and can function between the frame 20 and a ground surface, or frame 20 and base 21, which is herein illustrated between first and second supports 60 and 62.

Figure 3:
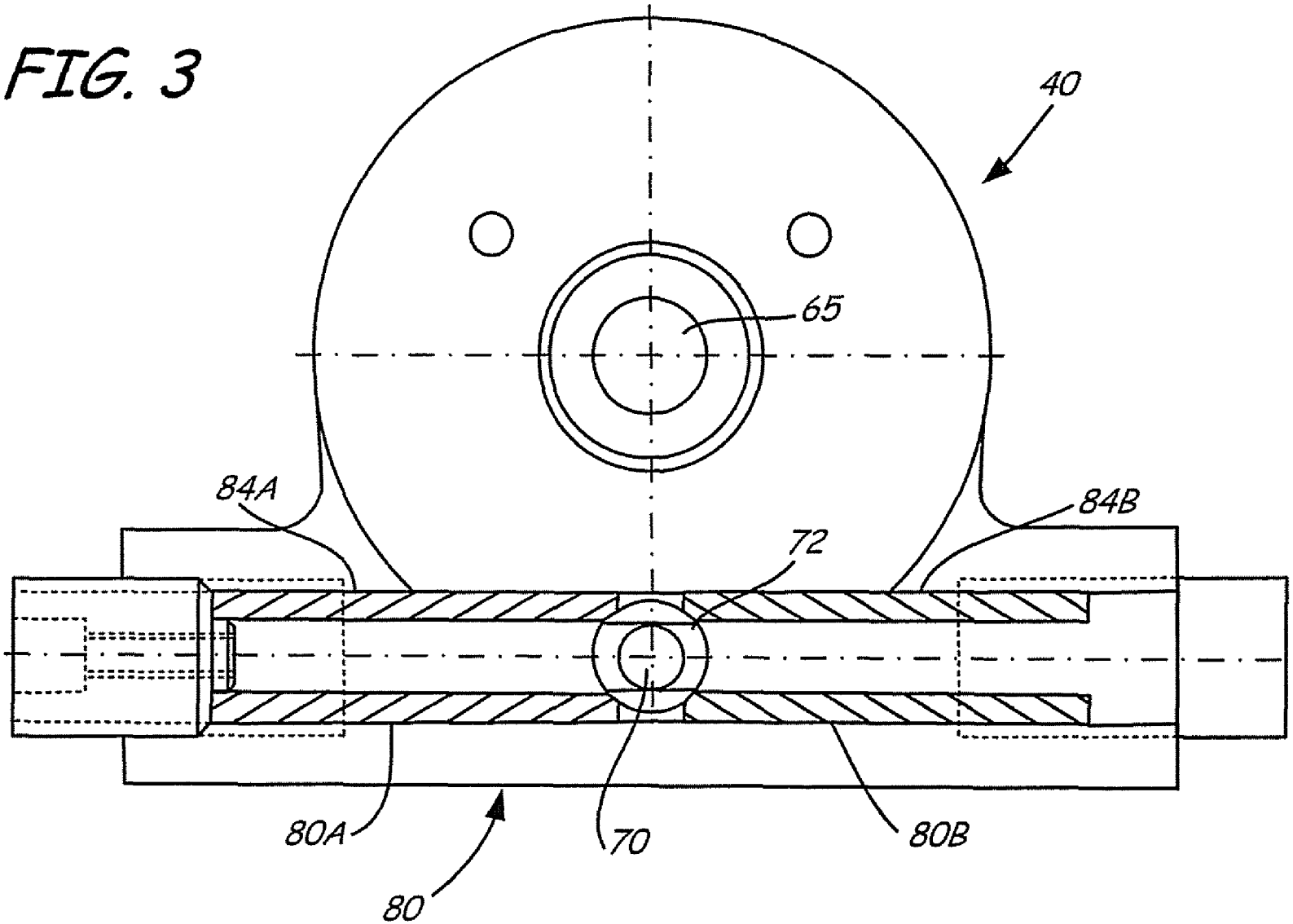
FIG. 3 is a schematic view of a pivoting assembly.

In particular, as schematically illustrated in FIG. 3, a pin 70 (herein mounted to support 60) extends in slot or recess 72 (herein provided in support 62) such that ends of the slot 72 form stop surfaces that engage pin 70 at the extent of tilting movement desired. In a further embodiment, the stop members can be adjustable if desired to change the extent of tilting or side to side movement allowable. In a further embodiment, adjustable members (not shown) can be used to adjust the length of the slot 72; however this is just one embodiment, wherein the manner in which stop surfaces can be moved will vary depending on the stop mechanisms employed.

The extent of tilting provided between frame 20 and base 21 as illustrated by double arrow 27 may vary depending on the cyclist, the type of bicycle, etc. In yet a further embodiment, a locking mechanism can be provided to selectively lock the relative positions of the frame and base, for example, such a locking device can comprise a locking pin to lock supports 60 and 62 together and prevent rotation.

As discussed above, rotation of support members 60 and 62 on pivot axis 64 allows tilting movement of frame 20 relative to base 21. In a further embodiment, such tilting movement is resisted. Various resistance mechanisms can include biasing elements such as springs, elastic materials, resilient materials, dampers, friction couplings or the like can be used to provide such resistance. In the embodiment illustrated, spring(s) 80 are used and can be provided in coupler 40 so as to provide a compact assembly. Likewise, other forms of resistance mechanisms can also be disposed in the coupler 40 so as to provide a compact device.

In the embodiment schematically illustrated in FIG. 3, two springs 80A and 80B are disposed in coupler 40, for example in recesses 84A and 84B respectively, so as engage pin 70 and resist movement thereof. Springs 80A and 80B provide resistance, and a restoring force, due to compression thereof; however, as appreciated by those skilled in the art, springs that operate in tension can also be used. Furthermore, other forms of springs such a torsion spring can be used, for example, being operably coupled to supports 60 and 62.

Figure 5:
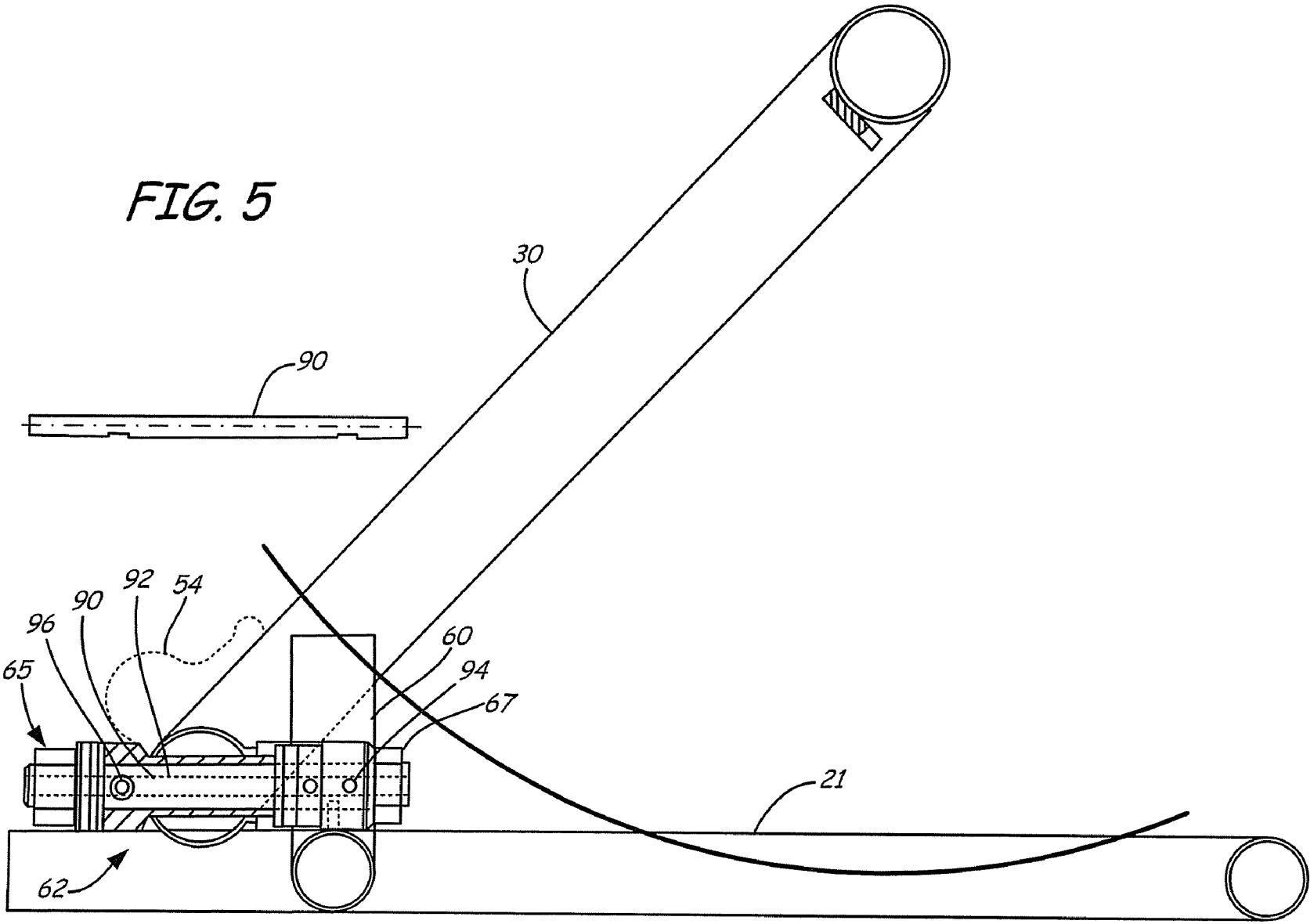
FIG. 5 is a side view of a bicycle trainer.
Figure 6:
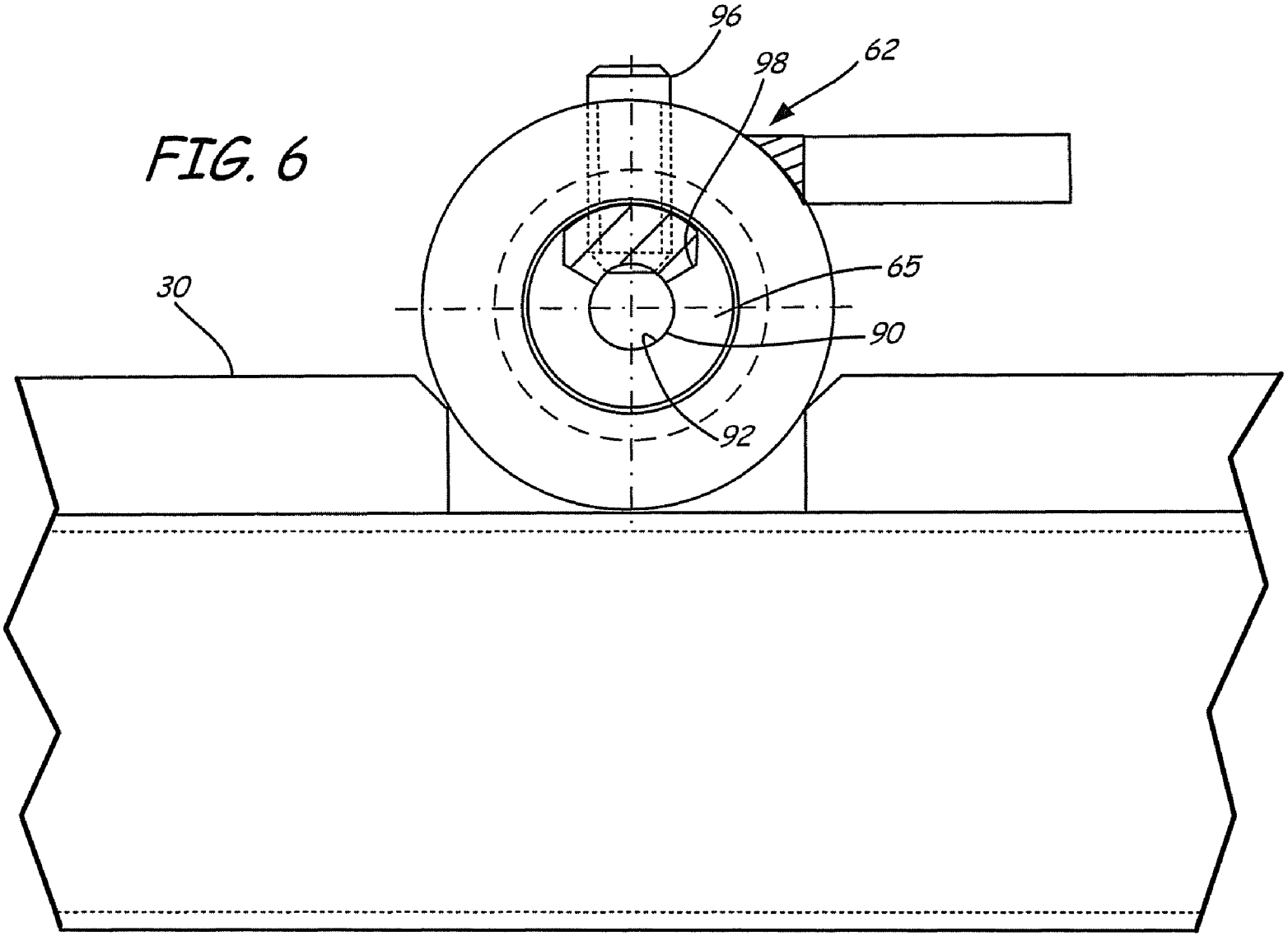
FIG. 6 is a schematic view of a pivoting assembly.

In yet a further embodiment illustrated in FIG. 5, the spring can comprise a torsion rod 90 disposed in and extending within a center bore 92 of stud 65. A fastener (herein a set screw 94) secures one end of torsion rod 90 to support 60, while another fastener (herein a set screw 96) secures the other end of torsion rod 90 to support 62. As illustrated in FIG. 6, recess 98 can be provided in stud 65 to allow set screw 96 to rotate in a limited range with torsion rod 90 and support 62, where walls of the recess 98 thereby provide stop surfaces.

If desired, the spring(s) can be removable and replaceable so as to allow the resistance to be changed. Alternatively, or in addition, mounting or engaging members of the spring(s) can be adjustable so as to vary the spring tension/compression, or apply a preload, in order to adjust the resistance and/or restoring force.

Although the subject matter presented herein have been described with reference to particular embodiments, workers skilled in the art will recognize that changes may be made in form and detail without departing from the spirit and scope of the subject matter presented in the appended claims.

What is claimed is:

1. A bicycle trainer frame adapted for use with a bicycle, the bicycle trainer frame comprising:

a base;

a frame having spaced apart ends adapted to engage and support the bicycle in a generally upright position with a wheel of the bicycle disposed between the ends, the frame being generally a hyperboloid having a central portion located between each of the ends; and a pivoting assembly joining the frame to the base at the central portion of the frame, the pivoting assembly having a single pivot, the pivoting assembly being the only support of the frame on the base, and allowing movement between the frame and the base such that the frame is allowed to tilt from side to side, the pivoting assembly including a torsion element having a first end non-rotatably coupled to the frame and a second end non-rotatably coupled to the base, and having an axis wherein the first end twists about the axis relative to the second end when the frame tilts from side to side, the torsion element resisting tilting of the frame relative to the base.

2. The bicycle trainer frame of claim 1 and further comprising a resistive unit joined to the frame proximate the central portion and having a roller adapted to engage a tire of the bicycle.

3. The bicycle trainer frame of claim 2 wherein the frame extends upwardly from the pivoting assembly from one portion of the base and is supported only by the pivoting assembly.

4. The bicycle trainer frame of claim 2 wherein the torsion element comprises a rod.

5. The bicycle trainer frame of claim 1 wherein the frame extends upwardly from the pivoting assembly from one end of the base.

6. The bicycle trainer frame of claim 5 wherein the frame extends in a direction toward a second end of the base.

7. The bicycle trainer frame of claim 1 wherein the base is generally U-shaped having a central portion equidistant from remote ends, and wherein the second end of the torsion element is joined to the central portion of the base, and the remote ends are supported only through the central portion.

8. The bicycle trainer frame of claim 1, wherein the torsion element is disposed entirely below at least a portion of the central portion of the frame.

9. A bicycle trainer adapted for use with a bicycle, the bicycle trainer comprising:

a base;

a frame having spaced apart ends adapted to engage and support the bicycle in a generally upright position with a wheel of the bicycle disposed between the ends, the frame being only one generally hyperboloid support having a central portion located between each of the ends;

a resistive unit joined to the frame proximate the central portion to tilt therewith, the resistive unit having a roller adapted to engage a tire of the bicycle; and a pivoting assembly joining the frame at the central portion to the base, the pivoting assembly having a single pivot, the pivoting assembly being the only support of the frame on the base, the pivoting assembly allowing movement between the frame and the base such that the bicycle is allowed to tilt from side to side, the pivoting assembly including a torsion element defining an axis between a first end non-rotatably coupled to the frame and a second end non-rotatably coupled to the base, the torsion element suspended between the first end and the second end, wherein the first end twists relative to the second end about the axis between the first end and the second end when the frame tilts from side to side, the torsion element resisting tilting of the frame relative to the base.

10. The bicycle trainer of claim 9 wherein the base is generally U-shaped having a central portion equidistant from remote ends, and wherein the pivoting assembly is joined to the base only at the central portion of the base.

11. The bicycle trainer of claim 10 wherein the remote ends terminate at a position away from the pivoting assembly.

12. The bicycle trainer of claim 9 wherein the frame extends upwardly at an inclined angle with respect to the base.

13. The bicycle trainer frame of claim 9 wherein the torsion element comprises a rod.

14. A bicycle trainer adapted for use with a bicycle, the bicycle trainer comprising:

a base;

a frame having spaced apart ends adapted to engage and support the bicycle in a generally upright position with a wheel of the bicycle disposed between the ends;

a resistive unit joined to the frame proximate a central portion of the frame to tilt therewith, the resistive unit having a roller adapted to engage a tire of the bicycle; and a pivoting assembly joining the frame at the central portion to the base, the pivoting assembly having a single pivot, the pivoting assembly being the only support of the frame on the base and allowing movement between the frame and the base such that when the bicycle is attached to the frame the bicycle will tilt from side to side, the pivoting assembly including a torsion element resisting tilting of the frame relative to the base through torsion, the torsion element being elongated along an axis between a first end non-rotatably coupled to the frame to a second end non-rotatably coupled to the base, and twists about the axis.

15. The bicycle trainer of claim 14 wherein the frame extends upwardly from the pivoting assembly from one end of the base.

16. The bicycle trainer of claim 15 wherein the frame extends in a direction toward a second end of the base.

17. The bicycle trainer of claim 14, wherein the frame comprises frame arms extending between the central portion and the spaced apart ends, and the torsion element is disposed entirely below the frame arms.

18. A method for supporting a wheel of a bicycle being used in a bicycle trainer positioned on a surface, comprising:

providing a roller of a resistance device to engage the wheel;

joining a frame to the resistance device to support the wheel on a first side and a second side of the wheel;

supporting the frame with a pivoting assembly having a torsion element with a first end coupled to the frame;

joining a base to a second end of the torsion element such that the frame is allowed to tilt relative to the base, wherein the frame is joined to the base at a pivot assembly having a single pivot where the pivoting assembly is the only support of the frame on the base; and twisting the first end of the torsion element torsionally relative to a second end of the torsion element during tilting of the frame relative to the surface, the torsion element resisting said twisting.

19. The method of claim 18 and further comprising:

connecting the wheel of the bicycle with only the roller of the resistance device and the frame during operation of the bicycle.

20. A bicycle trainer for use with a bicycle, the bicycle trainer comprising:

a base;

a frame coupled to the base and having opposed support ends for engaging the bicycle; and a pivoting assembly having means operating in torsional twisting for providing only one support for the frame and allowing the frame to tilt from side to side with respect to the base wherein the pivoting assembly couples the frame to the base at only one pivot, the pivoting assembly being the only support of the frame on the base.

* * * * *